US008894381B2

(12) United States Patent
Sato

(10) Patent No.: US 8,894,381 B2
(45) Date of Patent: Nov. 25, 2014

(54) COMPRESSOR CAPACITY CONTROL METHOD AND DEVICE FOR CONTROLLING THE CAPACITY OF A COMPRESSOR

(75) Inventor: Kazuaki Sato, Yokohama (JP)

(73) Assignee: Anest Iwata Corporation (JP)

( * ) Notice: Subject to any disclaimer, the term of this patent is extended or adjusted under 35 U.S.C. 154(b) by 616 days.

(21) Appl. No.: 12/958,476

(22) Filed: Dec. 2, 2010

(65) Prior Publication Data

US 2011/0129361 A1 Jun. 2, 2011

(30) Foreign Application Priority Data

Dec. 2, 2009 (JP) ..... 2009-274766

(51) Int. Cl.

| | |
|---|---|
| ***F04B 49/06*** | (2006.01) |
| ***F04B 49/08*** | (2006.01) |
| ***F04C 28/24*** | (2006.01) |
| ***F04C 28/28*** | (2006.01) |

(52) U.S. Cl.

CPC ..... *F04B 49/08* (2013.01); *F04B 49/065* (2013.01); *F04C 28/24* (2013.01); *F04C 28/28* (2013.01); *F04C 2240/81* (2013.01); *F04C 2270/01* (2013.01); *F04C 2270/86* (2013.01)

USPC ..... 417/44.2; 417/53; 417/290

(58) Field of Classification Search

CPC ..... F04B 49/065; F04B 49/08; F04C 28/24; F04C 28/28; F04C 2270/86; F04C 2240/81; F04C 2270/01

USPC ..... 417/44.2, 53, 290, 410.5

See application file for complete search history.

(56) References Cited

U.S. PATENT DOCUMENTS

| | | | | |
|---|---|---|---|---|
| 4,412,788 | A * | 11/1983 | Shaw et al. | 417/280 |
| 6,174,137 | B1 * | 1/2001 | Nakamura | 417/53 |
| 2003/0039550 | A1 * | 2/2003 | Wichert | 417/53 |
| 2004/0175273 | A1 * | 9/2004 | Dean et al. | 417/44.2 |

FOREIGN PATENT DOCUMENTS

| | | | | |
|---|---|---|---|---|
| DE | 4211191 | A1 | 10/1993 | |
| EP | 482592 | A1 * | 4/1992 | F04B 49/08 |
| EP | 0 482 592 | B1 | 1/1995 | |
| JP | 2684715 | B2 | 12/1997 | |
| JP | 3125794 | B2 | 1/2001 | |

OTHER PUBLICATIONS

German Office Action cited in German counterpart application No. DE 10 2010 053 280.0, dated Jun. 13, 2013. English translation provided.

* cited by examiner

*Primary Examiner* — Peter J Bertheaud
*Assistant Examiner* — Dominick L Plakkoottam
(74) *Attorney, Agent, or Firm* — Rossi, Kimms & McDowell LLP

(57) ABSTRACT

A compressor capacity control method and a device is provided. The changeover from a loading state regarding the compressor to an unloading state regarding the compressor and vice versa is controlled, whereby, during a time span from a starting time point when the compressor operation state changes into an unloading state to a time point when a loading/unloading operation-cycle is finished and a predetermined time duration has passed after the starting time point, the time cycle control is performed so that the loading state is changed into the unloading state, at a time point when the predetermined time duration has passed. Further, the discharge pressure of the fluid discharged from the compressor is detected so that the loading state is changed into the unloading state in a case where the discharge pressure exceeds a prescribed upper limit pressure.

6 Claims, 4 Drawing Sheets

COMPRESSOR CAPACITY CONTROL METHOD AND DEVICE FOR CONTROLLING THE CAPACITY OF A COMPRESSOR

BACKGROUND OF THE INVENTION

The present invention relates to a compressor capacity control method and device for controlling the capacity of a compressor by changing-over an unloading state to a loading state and vice versa.

In a conventional compressor-operation method, a capacity control method for controlling the flow rate of the gas (air) discharged from the compressor is performed so as to appropriately maintain the pressure of the gas on the loading side of the compressor. FIG. 7 explains an example cyclegraph as to a conventional capacity control method for a compressor. In general, during a loading state of a compressor, the flow rate of the air discharged from the compressor is greater than the air consumption on the loading side; accordingly, the pressure of the discharged air gradually increases during the loading state; and, in the conventional control method, the pressure of the discharged air is detected so that the pressure of the air in a piping on the loading side is maintained in a predetermined pressure range between an upper limit pressure and a lower limit pressure, by changing-over over the unloading state of the compressor to the loading state of the compressor and vice versa, in the pressure range, in response to the discharged air pressure.

A capacity control method as described above has been proposed; whereby, a loading/unloading state in a previous cycle (regarding load changeover repetition or cyclic pressure repetition) is observed so that the pressure to be controlled in a following cycle is computed, and the pressure control is performed; in the pressure control, the pressure level is moderately restrained within a range where the life time of the compressor is not deteriorated and an energy saving operation is realized.

For instance, JP2684715 discloses a method whereby a pressure sensor detects the change of the pressure on the air consuming side (the loading side); the loading/unloading repetition cycle time from an unloading state to the next unloading state via a full-loading state is grasped based on the detected change of the pressure; in a case where the grasped loading/unloading repetition cycle time is longer than a predetermined time span, an unload operation start-pressure (at which the compressor operation is changed-over toward an unloading operation) is reduced by an appropriate decrement within a predetermined allowable- and controllable-range; on the other hand, in a case where the grasped loading/unloading repetition cycle time is shorter than a predetermined time span, the unload operation start-pressure is increased by an appropriate increment within the predetermined allowable- and controllable-range; thus, the unload operation start-pressure is set closer to a pressure level of a full load operation; and, the stable pressure transition as a result saves energy (power) consumption.

Further, JP3125794 discloses a capacity control method whereby an on-off control valve is provided at the air suction side of the compressor; the on-off control valve changes-over a full-load operation to an unload operation (i.e. no load operation) and vice versa by use of the on-off action of the on-off valve, so that the air pressure on the discharged side of the compressor is kept within a range between an upper limit set-pressure $P_{max}$ (cf. FIG. 7) and a lower limit set-pressure $P_{min}$ (cf. FIG. 7); wherein, the upper limit set-pressure $P_{max}$ and the lower limit set-pressure $P_{min}$ are amended so that an on-off change-over period $\Delta t$ regarding the on-off valve is not shorter than a minimum period $\Delta t_{min}$; thus, the on-off change-over period in which the full-load operation is changed into no load operation or vice versa can be equal to or longer than a prescribed period. Accordingly, frequent change-over between the load modes can be evaded even where the load burdened upon the compressor stays at a high load level.

SUMMARY OF THE INVENTION

In the disclosed capacity control method according to the above-referenced patents, however, the pressure in a loading/unloading state in a previous cycle is detected so that the control pressure in a following cycle is computed based on the detected pressure in the previous cycle; thus, the computation procedures are inclined to be complex. Further, there may arise an apprehension that the period of the loading/unloading cycle become shorter in a case where the values regarding the control pressures computed on the basis of the changes in the air consumption are used; such a case often accompanies short life characteristics regarding the compressor or the compressor peripheries. Further, on the other hand, there may arise an apprehension that the period of the loading/unloading cycle become undesirably longer; in such a case, there may be caused a problem that the operation pressure becomes higher than a required level, accompanying energy losses.

Hence, in view of the problems in the conventional technologies as described above, the present invention aims at providing a compressor capacity control method and a device thereof for controlling the capacity of a compressor; whereby, the unloading/loading cycle of the compressor is appropriately controlled so that energy saving can be achieved and the life of the compressor can be prolonged.

In order to solve the problems, the present invention provides a compressor capacity control method for controlling the capacity of a compressor; thereby, the changeover from a loading state regarding the compressor to an unloading state regarding the compressor and vice versa is controlled so that the unloading/loading cycle of the compressor is repeated, namely, a time cycle control regarding the compressor is performed; whereby, during a time span from a starting time point when the compressor operation state changes into an unloading state to a time point when a loading/unloading operation-cycle is finished and a predetermined time duration has passed after the starting time point, the time cycle control is performed so that the loading state is changed into the unloading state, at a time point when the predetermined time duration has passed; and, the discharge pressure of the fluid discharged from the compressor is detected; in changing the loading state into the unloading state, an upper limit pressure control is performed, prior to the time cycle control, so that the loading state is changed into the unloading state in a case where the discharge pressure exceeds a prescribed upper limit pressure.

According to the present invention, the time cycle control regarding the compressor is performed so that the loading state regarding the compressor is changed into the unloading state, at a time point when the predetermined time duration has passed after the starting time point; thus, the capacity control of the compressor can be easily performed. Further, a loading/unloading cycle period (i.e. the predetermined time duration) is assumed to be constant; hence, the too long cycle-period can be evaded; accordingly, an excessively high operation pressure over a required level can be evaded; and, energy saving can be achieved and the life of the compressor can be prolonged. Hereby, in the time control, the predetermined time duration regarding the state changeover from the loading state to the unloading state or vice versa is established, for instance, based on the life of the compressor or the mean time between changeovers (an average time according to operation experiences or practices); naturally, the designer of the compressor device can determine the time duration on the basis of the design concept. The procedure to determine the time duration is not limited to a special approach.

Further, in a case where the pressure of the fluid discharged from the compressor exceeds the upper limit pressure, the time cycle control is performed so that the loading state is changed into the unloading state, at a time point when the predetermined time duration has passed; thus, an over-load operation as to the compressor can be evaded; and, the compressor can be operated so that the discharge air pressure is maintained within an appropriate pressure range. Further, as a variation of procedures for changing the compressor operation state into an unloading state, there may be approaches: to stop the motor driving the compressor, to close the opening on the suction side of the compressor, to close the suction side of the compressor without stopping the compressor operation, to open the suction side of the compressor without stopping the compressor operation, and to open the discharge side of the compressor without stopping the compressor operation as well as without supplying the discharged fluid toward an end-use device.

A preferable embodiment according to the present invention is the compressor capacity control method, wherein the unloading state regarding the compressor is changed into the loading state in a case where the discharge pressure becomes lower than a predetermined lower limit pressure, during the unloading state regarding the compressor. In this way, the unloading state regarding the compressor is changed into the loading state from the unloading state, when the discharge pressure reaches the predetermined minimum level; accordingly, the compressor can be operated so that the discharge air pressure is maintained within an appropriate pressure range.

Another preferable embodiment according to the present invention is the compressor capacity control method, wherein the loading state is not changed into the unload state in a case where the discharge pressure is not higher than a predetermined minimum level regarding the upper limit discharge pressure, at a time point when the predetermined time duration has passed after the starting time. In the time cycle control procedure, the loading state is changed into the unloading state only if the elapsed time reaches the predetermined time duration, even in a case where the unloading state continues for a lengthy time span or even in a case where the pressure does not reach a sufficient level after the unloading state is changed into the loading state; in order to overcome this weak point, a limiting condition is added that the operation state is not changed into the unloading state unless the discharge pressure exceeds the minimum level regarding the upper limit (discharge) pressure; thanks to this limiting condition regarding the compressor operation, the operation troubles are evaded.

Another preferable embodiment according to the present invention is the compressor capacity control method, wherein the loading state is not changed into the unloading state in a case where a loading time duration in a loading state regarding the compressor within the predetermined time duration is not longer than a predetermined minimum operation time span, at a time point when the predetermined time duration has passed after the starting time. As is the case with the former procedure in which the minimum level regarding the upper limit (discharge) pressure is set, the operation state is not changed into the unloading state unless the duration time regarding the loading state exceeds the predetermined minimum operation time span; thanks to this limiting condition regarding the compressor operation, the operation troubles regarding the compressor can be evaded.

Further, the present invention provides a compressor capacity control device, comprising: a compressor for generating compressed fluid; a pressure sensor for detecting the discharge pressure of the generated compressed fluid discharged from the compressor; an unloading means for setting the compressor in an unloading state regarding the compressor operation; a control means for controlling the unloading means so as to change-over a loading state regarding the compressor operation into an unloading state regarding the compressor operation and vice versa; the control means comprising: a timer for measuring elapsed time after a starting time point when the loading state regarding the compressor is changed into the unloading state regarding the compressor; a time cycle control section for controlling the unloading means so that the loading state regarding the compressor is changed into the unloading state, when the measured elapsed time reaches a predetermined operation time span; an upper limit pressure control section for controlling the unloading means so that the loading state regarding the compressor is changed into the unloading state, when the discharge air pressure detected by the pressure sensor exceeds a prescribed upper limit pressure, prior to the control by the time cycle control section.

A preferable embodiment according to the above-described device invention is the compressor capacity control device, wherein the unloading state regarding the compressor is changed into the loading state in a case where the discharge pressure becomes lower than a predetermined lower limit pressure, during the unloading state regarding the compressor.

Another preferable embodiment according to the present device invention is the compressor capacity control device, wherein the unloading means is not set in action in a case where the discharge pressure is not higher than a predetermined minimum level regarding the upper limit discharge pressure, at a time point when the predetermined time duration has passed after the starting time.

Another preferable embodiment according to the present device invention is the compressor capacity control device, wherein the unloading means is not set in action in a case where a loading time duration in a loading state regarding the compressor within the predetermined time duration is not longer than a predetermined minimum operation time span, at a time point when the predetermined time duration has passed after the starting time.

As described thus far, according to the present invention, the time cycle control is performed so that the loading state regarding the compressor is changed into the unloading state at a time point when the predetermined time duration has passed; thus, the compressor capacity control can be easily performed. Further, the period of the loading/unloading operation cycle (i.e. the predetermined time duration) is set as a constant time; thus, the too long cycle-period can be evaded.

Accordingly, an excessively high operation pressure over a required level can be evaded; and, energy saving can be achieved and the life of the compressor can be prolonged.

BRIEF DESCRIPTION OF THE DRAWINGS

The present invention will now be described in greater detail with reference to the preferred embodiments of the invention and the accompanying drawings, wherein.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

Figure 1:
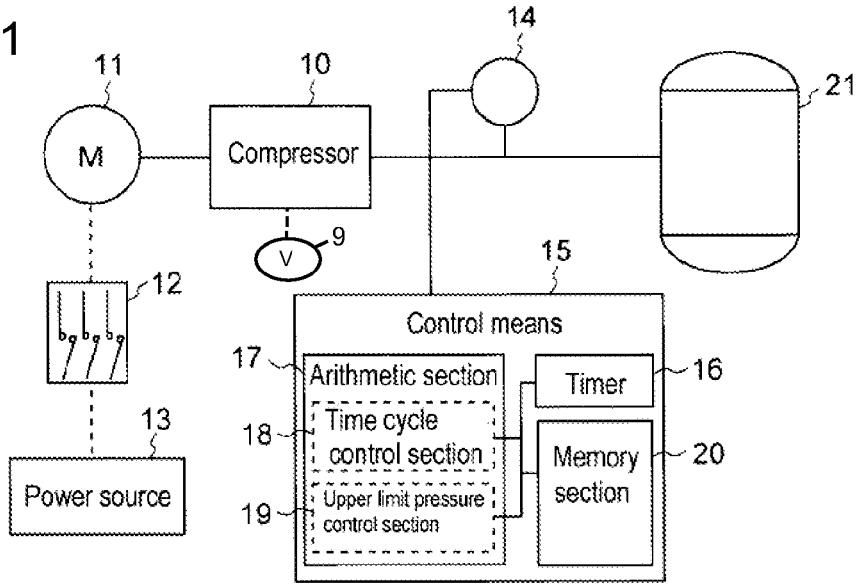
FIG. 1 shows an outline configuration of a compressor unit, according to a first embodiment of the present invention.

FIG. 1 shows an outline configuration of a compressor unit, according to a first embodiment of the present invention. In the example of the configuration of FIG. 1, an electromagnetic switch 12 for stopping a motor 11 that drives a compressor 10 serves as an unloading means for setting the compressor 10 in an unloading state; it is hereby noted, however, that the unloading means is not limited to this example. The examples of unloading means other than the above example are (1) a means by use of suction valves, (2) a means by use of blow-off valves and so on (both alternatives illustrated by element 9 in FIG. 1). To be more concrete, in the case (1) of the means by use of suction valves, the compressor operation is continued regardless of the movement of the unloading means; and, the suction valve opening is made adjustable so as to realize no load operation by throttling the valve opening. This manner is applied chiefly to the compressors of a screw type. Further, in another example of an unloading means that uses a suction valve, the compressor operation is continued so as to realize no load operation by opening the suction valve. This manner is applied to the compressors of a reciprocating type. In the case (2) of the means by use of blow-off valves, the compressor operation is continued so as to realize no load operation by opening the blow-off valve.

The compressor unit is provided with a motor 11 that drives a compressor 10 usually connected to a power source 13, an electromagnetic switch 12 that performs on-off control of the motor 11, a pressure sensor 14 that detects the pressure of the air discharged from the compressor 10, and a control means 15 that changes-over the compressor unloading state to the compressor loading state and vice versa. Incidentally, in FIG. 1, the following items are not shown: a suction side valve device such as a suction valve that regulates the suction air flow rate, a discharge side valve device such as a discharge valve with a check valve whereby the discharge valve regulates the discharge air flow rate and the check valve prevents the discharge air flow from back-streaming, a safety valve that protects abnormal air-pressure increase, and peripherals such as a filter, a dryer and an after-cooler.

The compressor 10 of the compressor unit inhales working fluid (e.g. air) into a compression chamber; a compression means driven by the motor 11 compresses the working fluid and yields compressed air. There is no specified kind or type as to the compressor; the compressor may a displacement type compressor such as a screw compressor or a reciprocating type compressor; or, the compressor may be a turbo-compressor such as a centrifugal compressor or an axial compressor.

Figure 2:
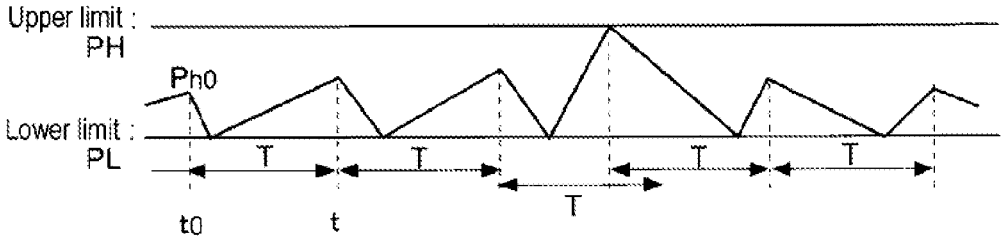
FIG. 2 shows a pressure cyclegraph for explaining the basic compressor capacity control method according to embodiments of the present invention.

The control means 15 is provided with a timer 16 that measures elapsed time, an arithmetic section 17 that performs various necessary computations, a memory section 20 in which various to-be-specified values are stored. The timer 16 measures elapsed time thereby the measurement starting time is initialized as t=0 when the compressor operation state changes into an unloading state. The arithmetic section 17 is provided with a time cycle control section 18 and an upper limit pressure control section 19. As shown in FIG. 2, the time cycle control section 18 performs a loading/unloading cycle operation control (a time cycle control) regarding the compressor 10, during a time span from the time point (t=0) when the compressor operation state changes into an unloading state to a time point when a loading/unloading operation cycle is finished, namely to a time point of the next operation change-over into an unloading state. Thus, the time cycle control section 18 again changes the loading state into the unloading state at a time point t=T when the predetermined time duration T has passed after the time point t=0.

The upper limit pressure control section 19 performs an upper limit pressure control so that the compressor loading state is changed into the unloading state in a case where the discharge air pressure P detected by the pressure sensor exceeds a prescribed upper limit pressure PH, prior to the control by the time cycle control section, namely, even when the time duration T has not passed after the time point t=0 and the time cycle control section 18 does not start the operation change-over from the loading state to the unloading state. In other words, the upper limit pressure control section 19 can perform the operation change-over, prior to the arithmetic section 17.

The memory section 20 stores data regarding the predetermined time duration T which the time cycle controlling section 18 uses and the upper limit pressure PH which the upper limit pressure control section 19 uses. The predetermined time duration T is a time period from the time point (t=0) when the compressor operation state changes into an unloading state to a time point when a loading/unloading operation-cycle is finished, namely to a time point of the next operation change-over into an unloading state. The time span T is prescribed, for instance, based on the compressor life taken into consideration, or an average time span corresponding to the loading/unloading operation cycles; naturally, the designer of the compressor device can determine the time T on the basis of the design concept other than the manners just as described.

The upper limit pressure PH is prescribed based on an allowable upper limit pressure regarding the compressor itself, or in reference to the consumption rate of the compressible fluid; naturally, the designer of the compressor device can determine the upper limit pressure PH on the basis of the design concept other than the manners just as described.

As described thus far, by use of the timer 16 and the time cycle control section 18 that are provided in the control means 15, the operation of the compressor 10 is changed into a loading state from an unloading state within the predetermined time duration T; thus, the operation cycle control with regard to the elapsed time is performed. In this way, a compressor capacity control method can be easily performed. Further, the period of the loading/unloading operation cycle is set as a constant time; thus, the too long cycle-period can be evaded; accordingly, an excessively high operation pressure over a required level can be evaded; and, energy saving can be achieved and the life of the compressor can be prolonged.

Further, the upper limit pressure control section 19 provided with the control means 15 works prior to the time cycle control section 18 (i.e. prior to the time cycle control) so that the compressor operation is changed into the unloading state from the loading state, in a case where the pressure of the air discharged from the compressor 10 exceeds the upper limit pressure PH. In this way, an over-load operation as to the compressor 10 can be evaded; and, the compressor can be operated so that the discharge air pressure is maintained within an appropriate pressure range.

Further, as shown in FIG. 2, the control means preferably changes-over the compressor operation from an unloading state to a loading state, when the pressure of the air discharged from the compressor 10 reaches a lower limit pressure PL during the unloading state. Thus, the control means 15 changes the changes-over the compressor operation from an unloading state to a loading state, when the discharge pressure reaches the lower limit pressure PL; and, the compressor can be operated so that the discharge air pressure is maintained within an appropriate pressure range.

First Embodiment

Figure 3:
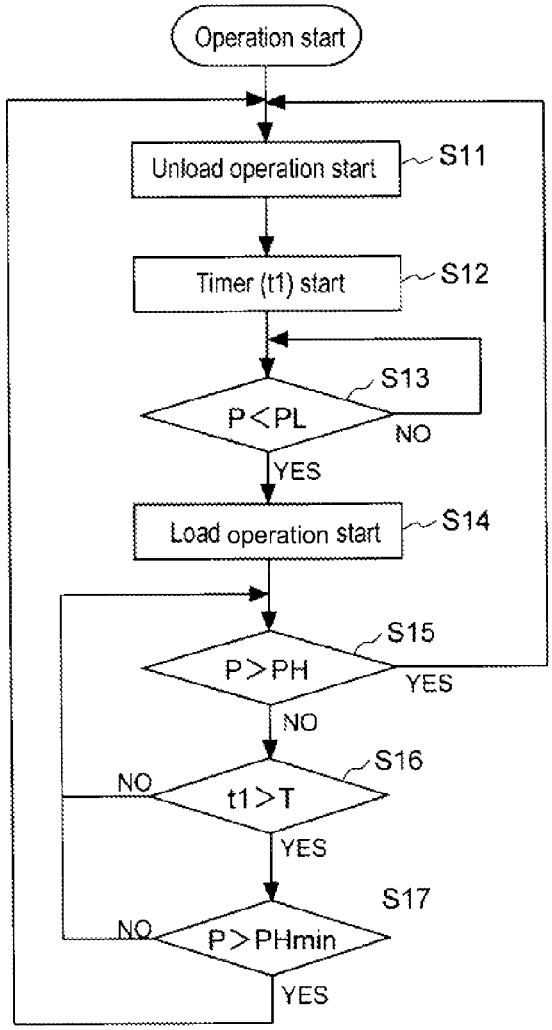
FIG. 3 shows a flow chart of the compressor capacity control method according to the first embodiment.
Figure 4:
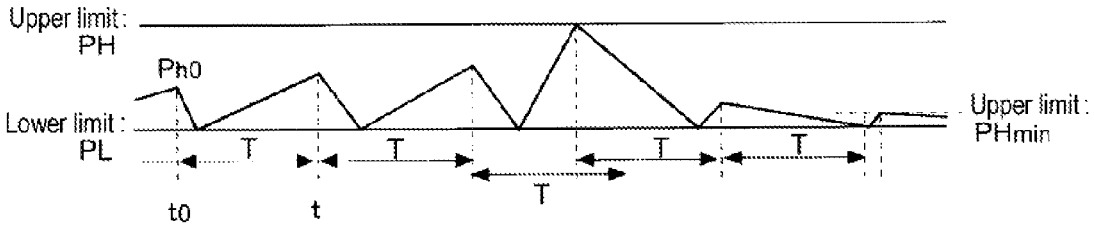
FIG. 4 shows a pressure cyclegraph for explaining the compressor capacity control method according to the first embodiment.

FIG. 3 shows a flow chart of the compressor capacity control method according to the first embodiment; FIG. 4 shows a pressure cyclegraph for explaining the compressor capacity control method according to the first embodiment. Adding limiting condition (i.e. features) to the basic compressor capacity control method that is shown in FIGS. 1 and 2 provides configuration features regarding the first embodiment. The additional limiting condition is that the loading state is not changed into the unloading state in the time cycle regarding the compressor 10, in a case where the discharge pressure P of the air discharged from the compressor 10 does not exceeds a predetermined minimum level $PH_{min}$ regarding the upper limit (discharge) pressure PH at a time point T (i.e. t=T) when the predetermined time duration T has passed after the starting time point t0 (i.e. t=0). Incidentally, the minimum level $PH_{min}$ is set so that the value $PH_{min}$ is lower than the value PH.

When a loading state of the compressor 10 in the compressor device provided with the above-described configuration feature is changed into an unloading state (the step S11 in FIG. 3), then a starting time point t0 is set as t=0, and the timer 16 of the control means 15 starts; thus, the measurement as to the elapsed time t1 is started (the step S12). Thereby, in a case where the control procedure is desired to be started during a loading state, the starting time point t0 may be set when the discharge pressure P as to the compressor 10 reaches a predetermined pressure level Ph0; then, the loading state is changed into an unloading state. In changing the loading state into the unloading state, the control means 15 sets the electromagnetic switch 12 at an off-condition and stops the motor 11; thus, the compressor 10 is stopped.

The pressure sensor 14 detects the discharge pressure P of the compressor 10; the control means 15 judges whether or not the discharge pressure P is lower than the upper limit pressure PH which data is stored in the memory section 20 (the step S13); and, the control means 15 changes the unloading state into the loading state (the step S14), when the discharge pressure P becomes lower than the upper limit pressure PH. During the loading state, the control means keeps the on-condition of the electromagnetic switch 12 so that the motor rotates 11 and the compressor 10 is operated. The working fluid (i.e. air) inhaled into the compression chamber of the compressor 10 through a suction port thereof is compressed by the energy supplied from the driving motor 11, and the compressed air is discharged from the compressor 10 through a discharge port thereof. The discharged air is reserved in an air tank 21, and the pressure of the air increases to a predetermined level. The upper limit pressure control section 19 of the control means 15 judges whether or not the discharge pressure P exceeds the upper limit pressure PH which data is stored in the memory section 20 (the step S15); and, the control means 15 changes the loading state into the unloading state (the step S11), when the discharge pressure P becomes higher than the upper limit pressure PH.

While the discharge pressure P does not exceed the upper limit pressure PH, the time cycle control section 18 of the control means 15 judges whether or not the elapsed time t1 measured by the timer 16 exceeds the predetermined time duration T which data is stored in the memory section 20 (the step S16); and, the loading state is continued, while the elapsed time t1 does not exceed the predetermined time duration T. Then, in a case where the elapsed time t1 exceeds the predetermined time duration T, the control means judges whether or not the discharge pressure P exceeds the minimum level $PH_{min}$ regarding the upper limit (discharge) pressure (the step S17), the $PH_{min}$ data being stored in the memory section 20; and, the loading state is changed into the unloading state (the step S11) in a case where the discharge pressure P exceeds the minimum level $PH_{min}$; the loading state is continued regardless of the predetermined time duration T, in a case where the discharge pressure P does not exceed the minimum level $PH_{min}$ (the step S14).

According to the first embodiment, in the time cycle control procedure, the loading state is changed into the unloading state only if the elapsed time reaches the predetermined time duration T, even in a case where the unloading state continues for a lengthy time span or even in a case where the pressure does not reach a sufficient level after the unloading state is changed into the loading state; in order to overcome this weak point, a limiting condition is added that the operation state is not changed into the unloading state unless the discharge pressure P exceeds the minimum level $PH_{min}$ regarding the upper limit (discharge) pressure; thanks to this limiting condition regarding the compressor operation, the operation troubles regarding the compressor 10 can be evaded.

Second Embodiment

Figure 5:
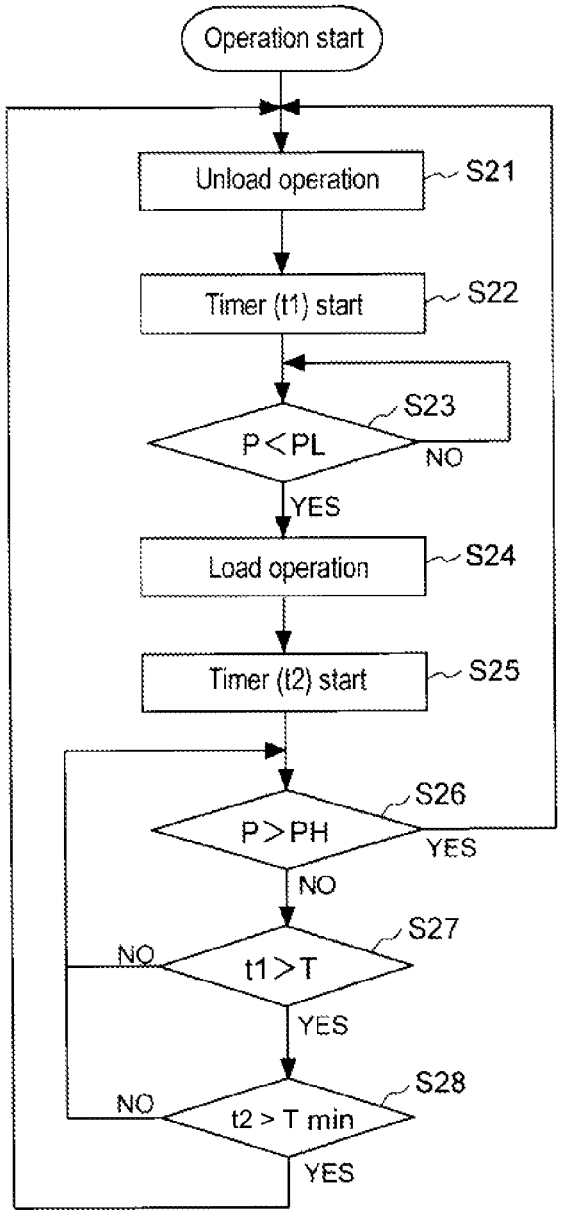
FIG. 5 shows a flow chart of the compressor capacity control method according to a second embodiment.
Figure 6:
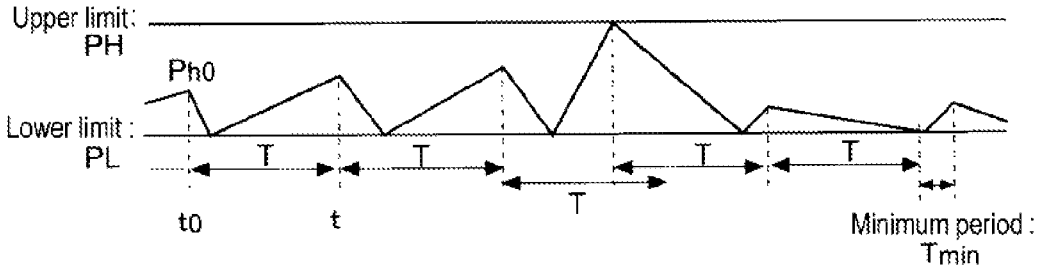
FIG. 6 shows a pressure cyclegraph for explaining the compressor capacity control method according to the second embodiment.
Figure 7:
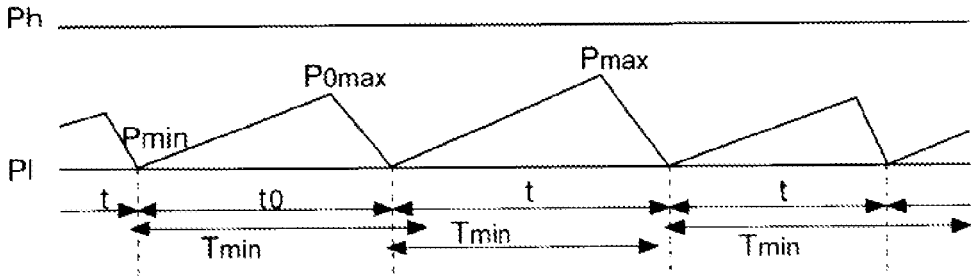
FIG. 7 explains an example pressure cyclegraph as to a conventional capacity control method.

FIG. 5 shows a flow chart of the compressor capacity control method according to a second embodiment; FIG. 6 shows a pressure cyclegraph for explaining the compressor capacity control method according to the second embodiment. In the second embodiment, a limiting condition (i.e. features) other than the limiting condition in the first embodiment is provided; the to-be-provided condition is that the loading state is not changed into the unloading state in the time cycle regarding the compressor 10, in a case where a (loading) time duration t2 of a loading state (regarding the compressor 10) at the time point of the predetermined time duration T does not exceeds a predetermined minimum operation time (span) $T_{min}$, the time duration T being the elapsed time after the starting time point t0. In addition, it is noted that the loading time duration t2 is an elapsed time at the time point t=T after the loading state has started. Incidentally, the minimum operation time (span) $T_{min}$ is set so that the value $T_{min}$ is shorter than the predetermined time duration T.

When a loading state of the compressor 10 in the compressor device provided with the above-described configuration feature is changed into an unloading state (the step S21 in FIG. 5), then a starting time point t0 is set as t=0, and the timer 16 of the control means 15 starts; thus, the measurement as to the elapsed time t1 is started (the step S22). When the operation state is changed into the unloading state, the control means 15 sets the electromagnetic switch 12 at an off-condition and stops the motor 11; thus, the compressor 10 is stopped. The pressure sensor 14 detects the discharge pressure P of the compressor 10; the control means 15 judges whether or not the discharge pressure P is lower than the upper limit pressure PH which data is stored in the memory section 20 (the step S23); and, the control means 15 changes the unloading state into the loading state (the step S24), when the discharge pressure P becomes lower than the upper limit pressure PH.

During the loading state, the control means keeps the on-condition of the electromagnetic switch 12 so that the motor rotates 11 and the compressor 10 is operated. The working fluid (i.e. air) inhaled into the compression chamber of the compressor 10 through a suction port thereof is compressed by the energy supplied from the driving motor 11, and the compressed air is discharged from the compressor 10 through a discharge port thereof. The discharged air is reserved in an air tank 21, and the pressure of the air increases to a predetermined level. Further, as soon as the loading state is started, a timer 16' of the control means 15 the timer 16' which is different from the timer 16 is started so as to measure the elapsed time t2 (the duration time t2) regarding the loading state (the step S25). The upper limit pressure control section 19 of the control means 15 judges whether or not the discharge pressure P exceeds the upper limit pressure PH which data is stored in the memory section 20 (the step S26); and, the control means 15 changes the loading state into the unloading state (the step S21), when the discharge pressure P becomes higher than the upper limit pressure PH.

When the discharge pressure P does not exceed the upper limit pressure PH, the time cycle control section 18 of the control means 15 judges whether or not the elapsed time t1 measured by the timer 16 exceeds the predetermined time duration T which data is stored in the memory section 20 (the step S27); and, the loading state is continued, when the elapsed time t1 does not exceed the predetermined time duration T. Then, in a case where the elapsed time t1 exceeds the predetermined time duration T, the control means judges whether or not the duration time t2 regarding the loading state exceeds the predetermined minimum operation time (span) $T_{min}$ (the step S28); and, the loading state is changed into the unloading state (the step S21) in a case where the duration time t2 exceeds the predetermined minimum operation time (span) $T_{min}$; the loading state is continued regardless of the predetermined time duration T, in a case where the duration time t2 does not exceed the predetermined minimum operation time (span) $T_{min}$ (the step S25).

According to the second embodiment, in the time cycle control procedure, the loading state is changed into the unloading state only if the elapsed time reaches the predetermined time duration T, even in a case where the unloading state continues for a lengthy time span or even in a case where the pressure does not reach a sufficient level after the unloading state is changed into the loading state; in order to overcome this weak point, a limiting condition is added that the operation state is not changed into the unloading state unless the duration time t2 regarding the loading state exceeds the predetermined minimum operation time (span) $T_{min}$; thanks to this limiting condition regarding the compressor operation, the operation troubles regarding the compressor 10 can be evaded.

The invention has been described with reference to certain preferred embodiments thereof. It will be understood, however, that modifications and variations are possible within the scope of the appended claims.

What is claimed is:

1. A compressor capacity control device, comprising:

a compressor for generating compressed fluid;

a pressure sensor for detecting the discharge pressure of the generated compressed fluid discharged from the compressor;

an unloading means for setting the compressor in an unloading state and a loading state;

a control means for controlling the unloading means so as to change-over a loading state regarding the compressor operation into an unloading state regarding the compressor operation and vice versa; the control means comprising:

a timer for measuring elapsed time after a starting time point when the loading state regarding the compressor is changed into the unloading state regarding the compressor;

a time cycle control section for controlling the unloading means so that the loading state is changed into the unloading state, when the measured elapsed time reaches a predetermined operation time span; and an upper limit pressure control section for controlling the unloading means so that the loading state is changed into the unloading state, when the discharge air pressure detected by the pressure sensor exceeds a prescribed upper limit pressure, prior to the control by the time cycle control section;

wherein the control means controls the unloading means to change the unloading state into the loading state in a case where the discharge pressure becomes lower than a predetermined lower limit pressure;

wherein the control means controls the unloading means to change the loading state to the unloading state when the measured elapsed time exceeds a predetermined operation time and the discharge pressure is higher than a minimum level pressure; and wherein the minimum level pressure is between the lower limit pressure and the upper limit pressure.

2. A device for controlling the capacity of a compressor comprising:

a pressure sensor that detects a pressure of air discharged from a compressor;

an unloading mechanism that changes the operation of the compressor between a loading state and an unloading state; and a control mechanism including a timer that controls the operation of the unloading mechanism;

wherein the control mechanism controls the unloading mechanism to change the operation of the compressor from the unloading state to the loading state when the pressure detected by the pressure sensor is less than a lower limit pressure;

wherein the control mechanism controls the operation of the unloading mechanism to change the operation of the compressor from a loading state to an unloading state when the pressure detected by the pressure sensor exceeds an upper limit pressure;

wherein the control mechanism controls the operation of the unloading mechanism to change the operation of the compressor from a loading state to an unloading state when the pressure detected by the pressure sensor is less than the upper limit pressure but greater than a minimum level pressure and an elapsed time measured by the timer is greater than a predetermined time duration; and wherein the minimum level pressure is between the lower limit pressure and the upper limit pressure.

3. An apparatus as claimed in claim 2, wherein the unloading mechanism comprises a switch that controls a supply of power to a motor that drives the compressor.

4. An apparatus as claimed in claim 2, wherein the unloading mechanism comprises a suction valve.

5. An apparatus as claimed in claim 2, wherein the unloading mechanism comprises a blow-off valve.

6. A method for controlling the capacity of a compressor comprising:

detecting a pressure of air discharged from a compressor with a pressure sensor;

unloading mechanism that changing the operation of the compressor between a loading state and an unloading state with an unloading mechanism;

controlling the unloading mechanism with a control mechanism to change the operation of the compressor from the unloading state to the loading state when the pressure detected by the pressure sensor is less than a lower limit pressure;

controlling the operation of the unloading mechanism with the control mechanism to change the operation of the compressor from a loading state to an unloading state when the pressure detected by the pressure sensor exceeds an upper limit pressure; and controlling the operation of the unloading mechanism with the control mechanism to change the operation of the compressor from a loading state to an unloading state when the pressure detected by the pressure sensor is less than the upper limit pressure but greater than a minimum level pressure and an elapsed time measured by the timer is greater than a predetermined time duration, wherein the minimum level pressure is between the lower limit pressure and the upper limit pressure.

* * * * *